United States Patent [19]

Davenport

[11] Patent Number: 4,656,960

[45] Date of Patent: Apr. 14, 1987

[54] SAILBOAT TILLER EXTENSION HIKING STICK

[75] Inventor: Frank A. Davenport, Palatine, Ill.

[73] Assignee: StaFast Products, Inc., Palatine, Ill.

[21] Appl. No.: 816,639

[22] Filed: Jan. 6, 1986

[51] Int. Cl.[4] ..... B63H 25/06

[52] U.S. Cl. ..... 114/144 R; 114/162; 114/146; 74/471 XY; 74/491; 74/531; 74/480 B

[58] Field of Search ..... 114/162, 144 R, 146, 114/153; 74/531, 471 XY, 491, 480 B

[56] References Cited

U.S. PATENT DOCUMENTS

| | | | |
|---|---|---|---|
| 3,363,599 | 1/1968 | Hoekstra | 114/144 R |
| 3,929,086 | 12/1975 | Alter | 114/162 X |
| 4,262,619 | 4/1981 | Hine | 114/144 R |

*Primary Examiner*—Sherman D. Basinger
*Assistant Examiner*—Paul E. Salmon
*Attorney, Agent, or Firm*—Niblack & Niblack

[57] ABSTRACT

A sailboat steering assembly is provided which has a hiking stick that assumes fixed positions in use, but smoothly responds to any changes induced by manual manipulation of the helmsman. Typical swinging and flopping of the unattended hiking stick are eliminated.

7 Claims, 7 Drawing Figures

SAILBOAT TILLER EXTENSION HIKING STICK

BACKGROUND OF THE INVENTION

This invention relates to a sailboat tiller extension assembly or hiking stick which maintains a fixed position in any orientation and is smoothly and uniformly movable by manual manipulation during operation.

Sailboats of smaller size are generally steered by a tiller connected directly to a rudder or to a pivot shaft on which the rudder is mounted. The resting or normal position of the tiller is along the center line of the boat. To facilitate steering, a hiking stick is commonly attached to the forward or projecting end of the tiller to serve as an extension of the tiller from the boat's center line to the sailor at the boat rail.

The degree to which a boat tilts, or heels, determines the shape of its hull underwater. To achieve maximum performance, the helmsman strives to maintain the most desirable underwater shape. The optimum tilt constantly changes depending upon the speed of the boat and the wind. To maintain maximum speed, the crew shifts its weight as conditions change. In heavy breeze the crew goes out on the windward deck to hike, or lean over the water. Hiking is used to counteract excessive heeling in heavy winds.

In a light wind when the boat speed is low, resistance caused by friction between the hull and the water is reduced by making the boat heel intentionally, with the crew sitting on the leeward side and the helmsman using the hiking stick to put his weight to leeward.

A hiking stick should be moveable in all directions, both horizontal and vertical. At best, however, its use requires additional skill and increases the difficulty of managing the boat. Previous hiking sticks were subject to erratic, uncontrolled movement, including swinging and drooping, when unattended by the helmsman. During maneuvers such as tacking or coming about, encountered in racing or sailing in heavy weather, the sailor is inconvenienced and even endangered by the free movement of the projecting hiking stick, as the tiller and swinging stick sweep through the cockpit when direction is changed.

Recognition of the problem posed by prior art hiking sticks is addressed in U.S. Pat. No. 4,262,619. The improvement disclosed in that patent was to provide a telescoping shaft which could be secured conveniently by clipping the hiking stick to the tiller length.

U.S. Pat. No. 3,929,086 discloses a hiking stick which is spring-tensioned and is retractable within a tiller tube when not in use.

These prior art devices do not provide a satisfactory solution to the problem of movement of the unattended stick, but rather are directed to storage means when the stick is not in use.

BRIEF DESCRIPTION OF THE DRAWINGS

The present invention will be better understood in light of the description which follows, taken in conjunction with the drawings in which.

SUMMARY

The present invention provides a sailboat steering assembly having a rudder controlled by a tiller to which is attached a tiller-extension comprising: a base mounted to a forward portion of the tiller having a vertically disposed channel in an upper portion thereof and having an annular shoulder encompassing the channel; a compression axle or separate ring supported on the base shoulder, adapted to be compressed and deformed to a greater degree than said base when both said shoulder and said base are subjected to compressive force; an axle supported upon the compression ring or directly on the base and having a vertical and a horizontal channel disposed therein, said vertical channel extending through said axle and communicating with said vertical base channel, and having annular shoulders at each horizontal and vertical channel end which encompass each channel; a horizontal annular compression member which is mounted on an axle shoulder or which is part of the axle body; a yoke having a tiller-extension shaft at its upper end, and spaced-apart arms at the lower end thereof, the arms terminating in annular rings which mate with a horizontal compression member and communicate with a horizontal channel within the axle; a vertical end compression member adjustably positioned within each channel and adapted to apply pressure to the interior of the axle thereby causing compressive surface force for providing uniform and controlled resistance to movement of the tiller extension shaft end in both horizontal and vertical position.

DETAILED DESCRIPTION OF PREFERRED EMBODIMENTS

The present invention contemplates a typical hiking stick attached to a forward portion of a sailboat tiller in combination with an adjustable uniform resistance joint assembly of the present invention which permits controlled rotation of the stick about the horizontal and vertical axes. When released by the helmsman, the stick remains in a fixed position but responds readily to hand pressure causing changes in position without backlash or continuing uncontrolled movement when unattended.

In the broadest aspect, the tiller extension has a shaft with a handle at one end which is attached to a yoke terminating in two opposing, spaced apart arms which mate with horizontally disposed compression members carried on or which are an integral part of an axle. The axle is adjustably and compressibly mated with and supported on a base fixed to the sailboat tiller.

The assembly of the present invention provides a hiking stick that assumes fixed positions in use, but smoothly responds to any changes induced by manual manipulation of the helmsman. Typical swinging and flopping of the unattended hiking stick is eliminated.

Figure 1:
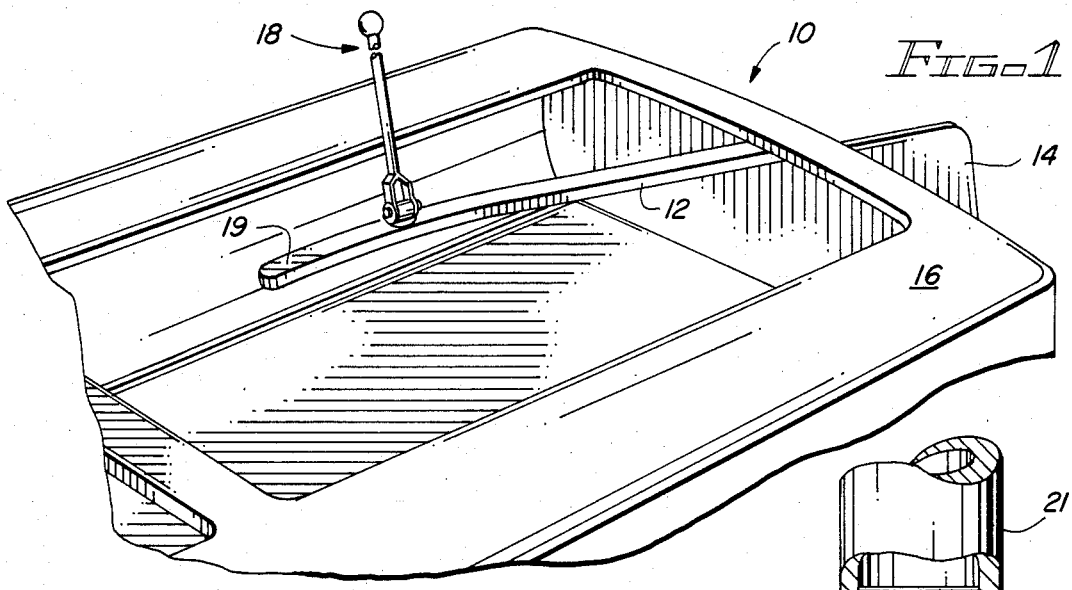
FIG. 1 is a perspective view of a sailboat stern.

Referring to the drawings, in FIG. 1, sailboat 10 is equipped with tiller 12 which controls rudder 14. Hiking stick 18 is attached to a fore portion 19 of the tiller. The hiking stick 18 is grasped in use by a sailer normally seated on or hiked out from boat rail 16.

Figure 2:
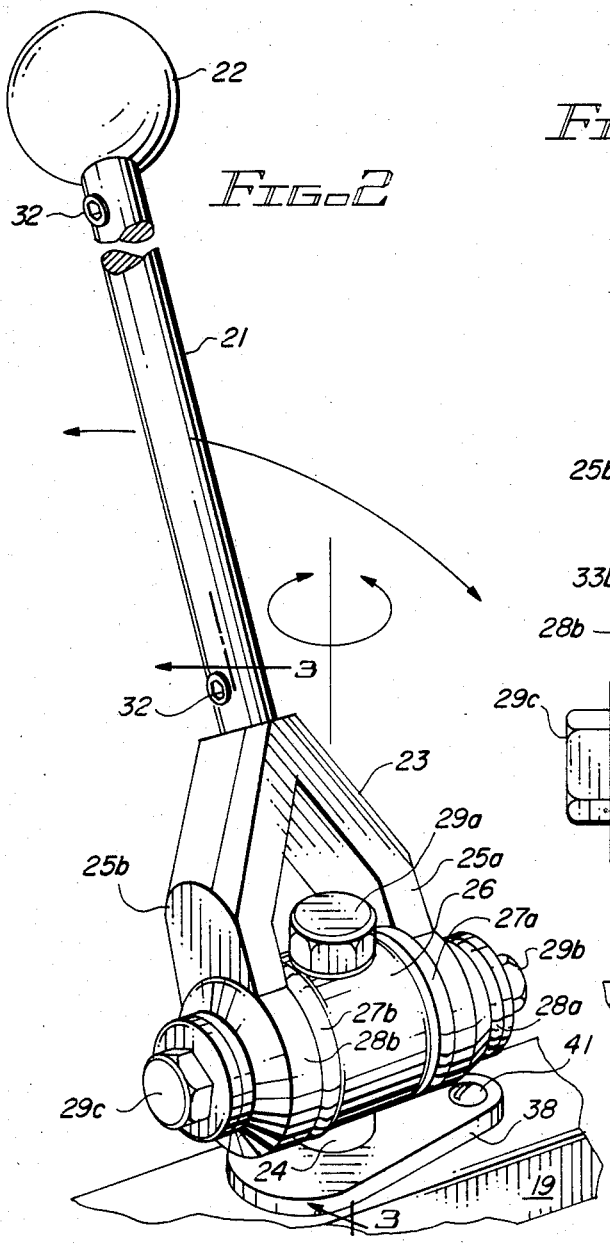
FIG. 2 is a perspective view of one embodiment of a hiking stick assembly of this invention.

In FIG. 2, extension shaft 21 has handle 22 at its outer end 21*a* and is connected to yoke 23 at opposing end 21*b*. Yoke arms 25*a* and 25*b* terminate in rings 33*a* and 33*b* as shown in FIG. 5. The yoke arms 25*a* and 25*b* cooperate with axle 26 and support compression washers 27*a* and 27*b* located between the axle body and the inner surface (not shown) of yoke arms 25*a* and 25*b*. The axle assembly is positioned upon base 24 which is attached to tiller fore portion 19. Outer horizontal compression washers 28*a* and 28*b* are positioned upon the exterior of the axle arms and are confined by horizontal cap screws 29*b* and 29*c*. Vertical cap screw 29*a* extends vertically through the axle to attach the assembly in base 24 as best shown in FIG. 3.

Figure 3:
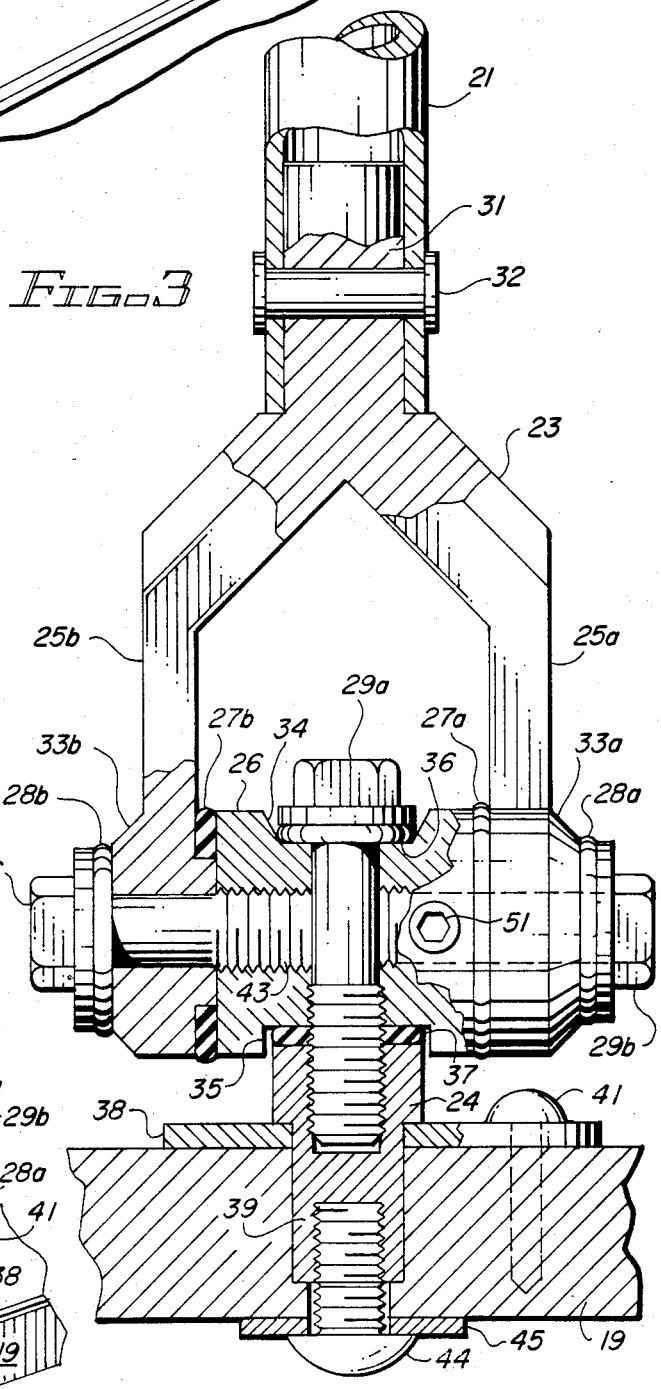
FIG. 3 is an elevational view of the hiking stick joint assembly of FIG. 2 with parts cut away for clarity.
Figures 4, 5:
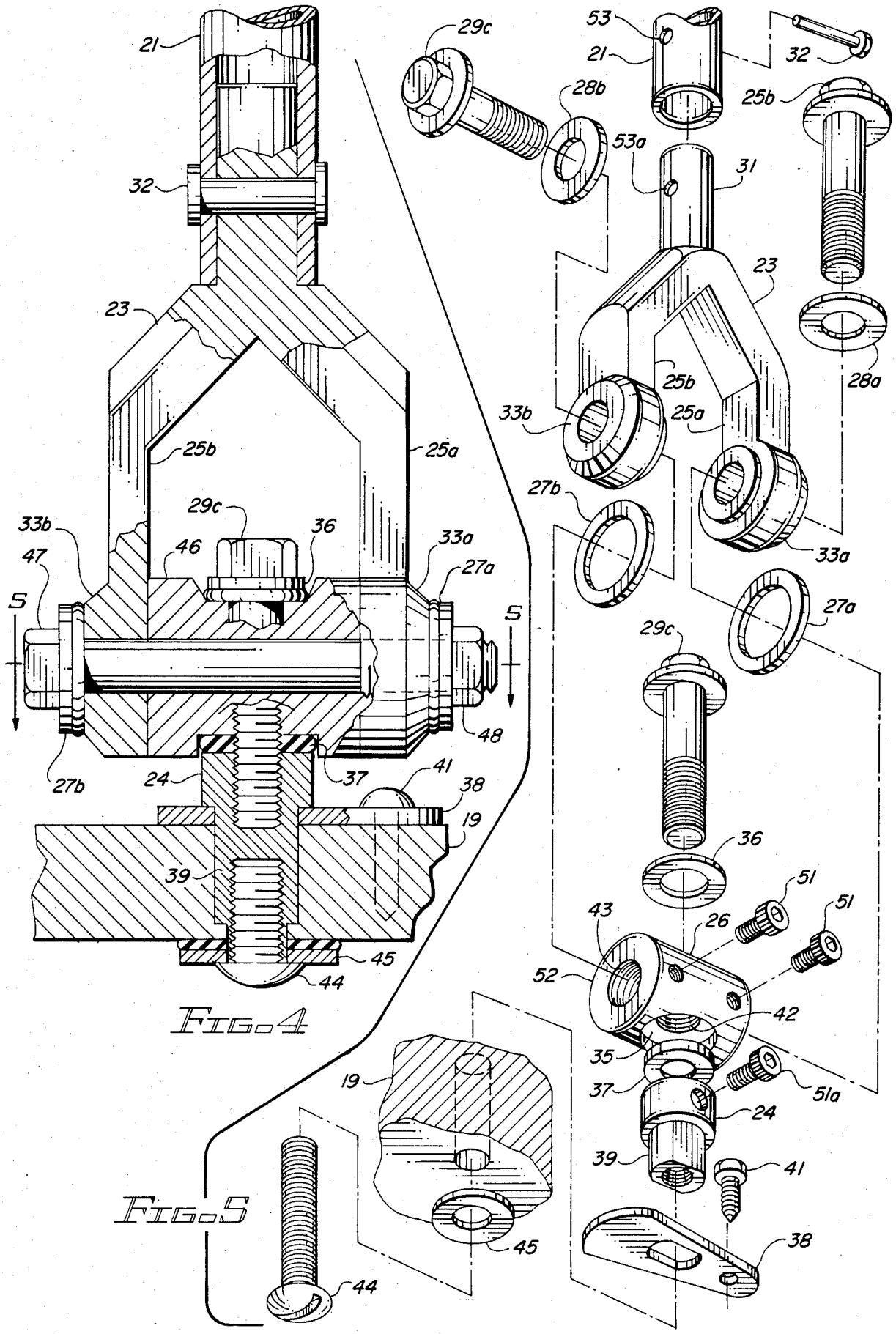
FIG. 4 is an elevational view of an alternate embodiment of the joint assembly with parts cut away for clarity.
FIG. 5 is a perspective exploded view of the hiking stick joint assembly of FIG. 3.

In FIG. 3, extension shaft 21 is positioned over yoke tongue 31, the two being joined by yoke pin 32. Yoke 23 terminates at an upper portion in arms 25*a* and 25*b* which in turn carry yoke rings 33*a* and 33*b*, respectively. Axle 26 carries compression washers 27*a* and 27*b* which are compressed between the axle and the yoke rings. Outer horizontal compression washers 28*a* and 28*b* contact the outer surfaces of the yoke rings and are confined and compressed by horizontal cap screws 29*b* and 29*c* that are positioned within horizontal axle channel 43.

Vertical axle channel 42 extends through the axle and communicates with base 24 which is mounted to tiller 19 by base sleeve 39 shown embedded in the tiller and which is fixedly mounted by base plate 38 secured by plate screw 41. Base screw 44 cooperating with washer 45 secures the base assembly to the tiller. A primary function of plate 38 is to prevent rotation of the entire base assembly. The axle assembly is supported by bottom axle compression washer 37 which is seated within axle bottom shoulder 35. Top axle compression washer 36 is nested in and supported by top axle shoulder 34. Vertical cap screw 29*a* passes through the upper and lower compression washers at either side of axle 26 and is threaded into the vertical channel of base 24 to join the axle and base portions of the assembly.

Figure 7:
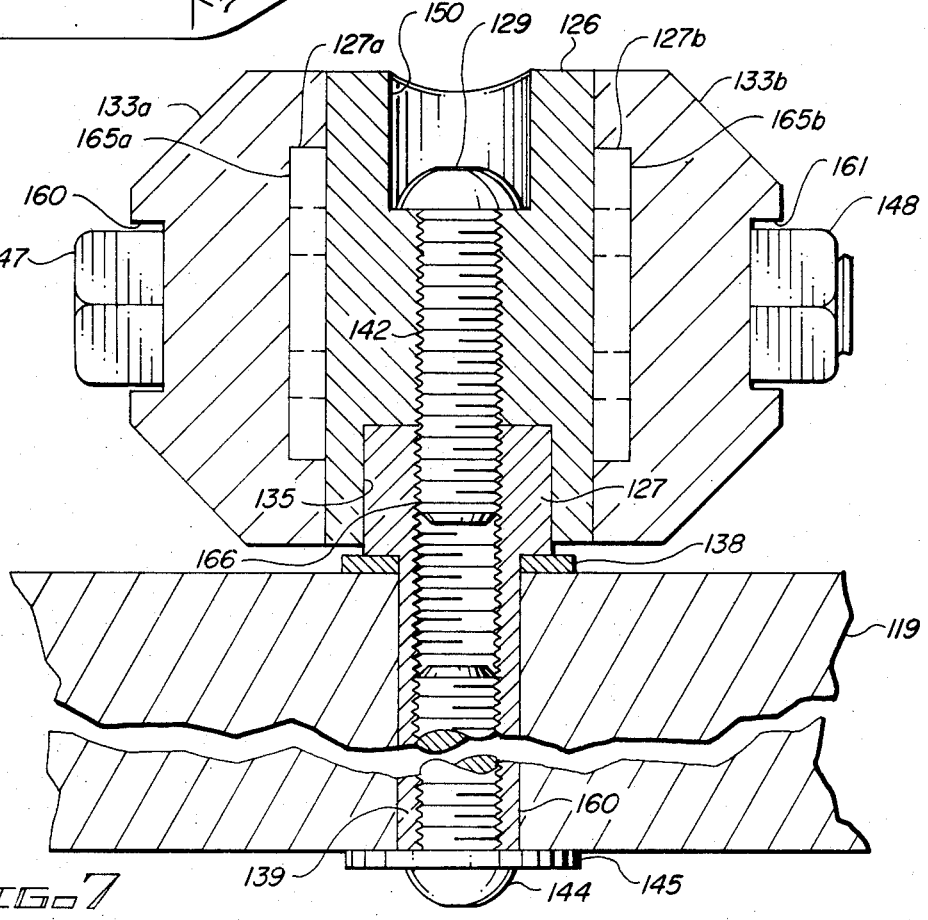
FIG. 7 is a cross-sectional view of the embodiment of FIG. 6 taken along lines 7—7.

FIG. 4 depicts an alternate axle assembly in which the inner horizontal compression elements and the axle body are unitary. In this embodiment, axle 46 comprised of suitably compressible material directly contacts yoke rings 33*a* and 33*b* carried by yoke arms 25*a* and 25*b*. Cap bolt means 47 extends completely through the horizontal channel of the axle and mates with cap lock nut 48 to provide compressive force to the yoke arms which in turn transmits the force to the axle body. While FIGS. 2, 3 and 5 depict two horizontal channels in the axle with separate screw means, and upper and lower compression rings 36 and 37 are provided, it is not esential to have paired compression means at either vertical or horizontal sides of the axle. Utilizing an axle body of the proper material which is suitably more deformable under compression than the force-transmitting members, i.e., the yoke rings, screw means and base, separate compression members may be eliminated and a unitary axle structure substituted for them. These alternatives are best illustrated in FIGS. 4 and 7.

FIG. 5 is an exploded view of the assembly of FIG. 3. Extension shaft 21 is mated with yoke tongue 31 and fastened together with pin 32 through matching ports 53 and 53*a*. Yoke 23 which terminates in yoke rings 23*a* and 23*b* extending from arms 25*a* and 25*b* respectively, which are horizontally aligned with outer compression washers 28*a* and 28*b* and inner compression washers 27*a* and 27*b* upon axle shoulders 52 to form horizontal channel 43. Screw means 29*b* and 29*c* confine and compress the yoke to permit controlled vertical changes in position. Socket head set screws 51 screwed into the axle body and intercepting horizontal channel 43 provide means for locking the screw means to a pre-determined degree of compression. Screw means 29*c* passing through compression ring 36 which nests into the upper shoulder of the axle (not shown in FIG. 5) passes through the vertical channel 42 and through bottom compression ring 37 which is nested within bottom axle shoulder 35 to matingly engage the channel within base 24. Socket head base set screw 51*a* extends into base 24 to intercept the vertical channel and lockingly engage screw means 29*c* to a predetermined degree of compression. Base sleeve 39 is set in the tiller (not shown) and is lockingly mounted therein by means of base screw 44 and washer 45.

Figure 6:
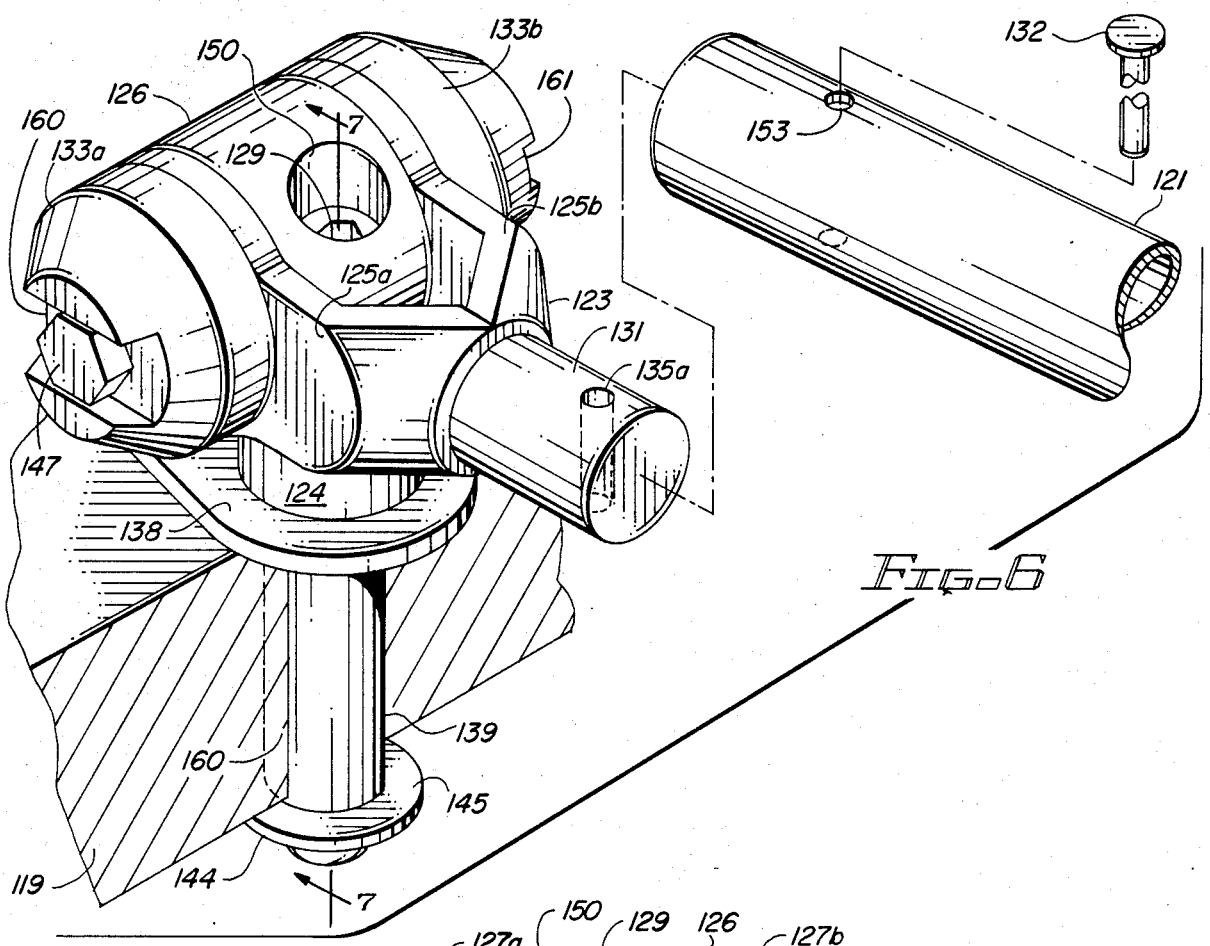
FIG. 6 is a partial exploded perspective view of a further embodiment of the assembly with some parts cut away and others shown in phantom for clarity.

FIG. 6 depicts another embodiment of the axle and base joint assembly attached to the yoke in which axle 126 is itself the compression member similar to the axle 26 shown in the embodiment of FIG. 4.

Unitary compressible axle 126 is supported on base 124. The assembly is anchored to boat tiller 119 by the base set within plate 138 and through tiller channel 160 encasing base shank 139. Base screw 144 inserted through washer 145 is threaded fixedly into the vertical axle channel as shown in FIG. 7. Axle vertical screw 129 is threaded through an upper portion of the vertical channel within the axle (See FIG. 7), and is nested in upper axle well 150. Horizontal yoke rings 133*a* and 133*b* form the termini of yoke arms 125*a* and 125*b* which are in turn appended to the yoke 123 that carries tongue 131 fitted with channel 153*a* mating with handle hole 153 which accommodates yoke pin 132 to fix shaft 121 to the yoke. Bolt 147 is set by nut 148 in compressive contact with yoke rings 133*a* and 133*b* by placement within horizontal yoke slots 160 and 161.

FIG. 7, a cross-sectional view taken along lines 7—7 of FIG. 6, shows detail of the axle and compression washer assembly of an alternate embodiment. The vertical compression washers 36 and 37 of FIGS. 3, 4 and 5 are eliminated and axle 126 is directly carried on base 124 nested in axle bottom well 135. Adjustable compressive force is applied to the axle directly by vertical screw 129 passing through vertical channel 142 and threaded into base channel 166. Vertical screw 129 is seated within top axle well 150. While the vertical compression washers are eliminated in this embodiment, interior horizontal washers 127*a* and 127*b* are seated within slots 165*a* and 165*b* of yoke rings 133*a* and 133*b* to transmit compressive drag force to the center of the assembly so as to permit controlled resistance swing of the yoke handle subassembly. While the horizontal interior washers have been retained in this embodiment, compared to the two pairs of yoke washers of FIG. 5, by selection of proper axle material, as described in this specification, these can also be eliminated or positioned on the exterior of the yoke rings as shown in FIG. 4 so that the axle surface serves as the compressive slip member.

While provision of lock screws 51 and 51*a* as shown in FIGS. 3 and 5 add an extra degree of control and may cause the assembly to require less frequent tension adjustments, they are not critical and may be compensated for by using the structures of FIGS. 6 and 7.

Suitable compression means required to cause internal tension in the joint assembly includes any mechanical expedient that exerts axial force inwardly to the surfaces of compressible elements more centrally located in the joint assembly. These include bolts placed through the central channels of the base and axle components as shown in FIGS. 3 and 4, screw caps or screws and washers, outside spanner clamps, bolts set within retaining slots as shown in FIG. 6 and like devices adapted to exert squeeze or bilateral tension to the center of the hiking stick joint component.

While some embodiments of the assembly of the present invention employ cap screws and locking set screws, these are refinements that are not required. While they may add elegance in some applications, their inclusion may be undesirable in others because of the components added, necessity of additional adjustments and tools required and their cost.

The critical aspect of this invention concerns the central vertical and horizontal slip elements including the compression/slip washers or alternatively, the moveable surfaces of the unitary central compressible elements such as the axle depicted in FIG. 4 which contact the base and yoke surfaces directly.

The term "compressible", as used herein, means discreetly or molecularly surface deformable upon the application of external bilateral force in comparison to the dimensional changes which occur in the external clamp elements, especially the axle or the base. Deformation which becomes visually perceptible will generally be excessive. Except in the case of separate compression components, such as washers, any deformation of multi-function parts such as the axle should be confined to their contact surfaces.

Suitable materials for fabrication of the compressible parts should have the following properties. Generally, it is preferred that the material be moldable or easily machined for low cost manufacture. The resulting element should have good compression strength, low wear rates, be resistant to corrosion, moisture, and ultra-violet radiation, have an intermediate coefficient of friction and produce a surface that yields a smooth and silent drag when compressed and moved against other joint components in contact with it. The other joint elements, which are preferably stainless steel, include the yoke, the base, and clamp means.

A preferred material is butadiene-styrene polymers reinforced with cotton duck or other suitable fiber. Materials marketed as K-RESIN butadiene-styrene resin by Phillips Petroleum is highly suitable for production of this class of material. Glass fiber-reinforced polymers of this class are also suitable.

Another type of moldable material suitable for use in the practice of this invention is linear polyoxymethylene-type acetal resins such as those sold by DuPont under the trademark DELRIN or by L.N.P. as THERMOCOMP. Components manufactured from DELRIN 570 resin 2% glass fiber-reinforced homopolymer are suitably fabricated by injection molding as are those manufactured from THERMOCOMP KFX1006 resin which comprises 30 percent coupled glass fiber reinforced acetal resin.

A further material that has proved to be highly useful for injection molding production of the axle and yoke components, among others, is ultraviolet-stabilized, glass filled nylon, particularly 6/6, 6/12 30% glass nylon. Type 6/6 nylon is the condensation product of hexamethylene diamine (HMD) and adipic acid while type 6/12 is produced from HMD and dodecanoic acid. Although type 6/6 costs less than type 6/12, it has less flexibility and dimensional stability is improved by the addition of 20% or more of 6/12 component. The glass fiber loading, which is preferably about 30% by weight may be increased to about 50%. With 30% glass, a dry or molded tensile strength of over 20,000 psi and a modulus of elasticity of about 1.0 to 1.6 million psi is achieved.

Because embrittlement may occur from prolonged exposure to sunlight which can be expected in this application, the addition of about 2% finely dispersed carbon black is highly preferred and can be expected to prolong the life of the components several fold.

Other materials including glass, metal, and wood may be used but are ordinarily not preferred because of increased cost of fabrication compared to various types of polymer molding techniques, as well as more rapid wear of assembled parts requiring frequent tension adjustment and replacement of parts. Woods having a hardness value of greater than 850 and compression values in excess of 1000 (both perpendicular to the grain) as determined by the A.S.T.M. D143 (American Society for Testing and Materials) are satisfactory. Such woods include white ash, sugar maple, red and white oak.

The use of lubricated materials such as molybdenum filled plastics, and the like, are ordinarily disadvantageous as they unduly reduce the discreet drag qualities which are important to the performance of the assembly.

The prefrred plastic materials described above have low to intermediate coefficients of friction and will outwear unlubricated metal in the present setting.

It will be apparent to those skilled in the art that various modifications and alterations may be made without departing from the spirit and scope of the invention and the appended claims.

The invention claimed is:

1. A sailboat steering assembly having a rudder controlled by a tiller to which is attached a tiller-extension comprising: a base mounted to a forward portion of the tiller, having a vertically disposed member in an upper portion thereof and having an annular shoulder encompassing the member; a compression member supported on the base shoulder, adapted to be copressed and deformed to a greater degree than said base when both said shoulder and said base are subjected to force; an axle supported upon the base and having a vertical and a horizontal channel disposed therein, said vertical channel extending through said axle and communicating with said vertical base member, and having annular shoulders at each horizontal and vertical channel end and which encompass each channel; a horizontal annular compression surface mounted on an axle shoulder; a yoke having a tiller-extension shaft at its upper end, and spaced-apart arms at the lower end thereof, the arms terminating in annular rings which mate with a horizontal compression member and communicate with the horizontal channel of the axle; end compression screws adjustably positioned within each channel and adapted to apply pressure to the compression members thereby providing uniform and controlled resistance to movement of the tiller extension shaft end in horizontal and vertical positions.

2. The assembly of claim 1 wherein the axle has opposing horizontal channels at each of its ends and each shoulder carries a compression washer.

3. The assembly of claim 1 wherein the axle carries a compression washer on at least one shoulder.

4. The assembly of claim 1 wherein the annular rings of the yoke arms mate with compression rings on both interior and exterior arm surfaces.

5. A sailboat steering tiller extension comprising: a base mounted on a sailboat tiller, the base having a vertical threaded channel extending through at least an upper portion of its length, an upper shoulder carrying a compression ring encompassing the channel and the base being affixed to the tiller to prevent rotation thereof; an axle body having two horizontal arms and having a vertical channel extending throughout its length, each end of which terminates in a recessed shoulder which mates with and provides a compression surface surrounding the channel, a screw means positioned above and within the vertical channel passing through the axle and into the base channel, said axle further having a horizontal shoulder on each arm, each of said shoulders encompassing a channel extending at least partially through the length of the axle, and a deformable compression surface mating with each shoulder; a yoke having an upper end and a lower end, the upper end carrying a tiller extension member having a handle and the lower end having two spaced apart arms terminating in rings, the interior side of which mate with the compression surfaces of said axle and the exterior of which mate with second compression surfaces carried on the outer portion of each axle arm; and compression screws thereon threaded into the vertical and horizonal channels, end caps being carried by the screws and adapted to transmit pressure to the compression surfaces upon retraction of the screws within the channels.

6. The tiller extension of claim 5 wherein the compression surfaces of the axle comprise compression washers.

7. The extension assembly of claim 5 wherein the compression surfaces of the axle are unitary with the axle body.

* * * * *